US005816321A

United States Patent [19]

Wijkstrom

[11] Patent Number: 5,816,321

[45] Date of Patent: Oct. 6, 1998

[54] HEAT EXCHANGER TANK TO BE MOUNTED IN A HEAT EXCHANGER AND METHOD OF PRODUCING IT

[75] Inventor: Björn Wijkstrom, Asarum, Sweden

[73] Assignee: Valeo Engine Cooling Aktiebolag, Solvesborg, Sweden

[21] Appl. No.: 590,127

[22] Filed: Jan. 23, 1996

[30] Foreign Application Priority Data

Jan. 25, 1995 [SE] Sweden ..... 9500248

[51] Int. Cl.[6] ..... F28F 9/02

[52] U.S. Cl. ..... 165/173; 165/DIG. 476; 29/890.052; 228/135

[58] Field of Search ..... 165/173, 175, 165/DIG. 476; 29/890.052; 228/135, 183

[56] References Cited

U.S. PATENT DOCUMENTS

| | | | |
|---|---|---|---|
| 4,938,284 | 7/1990 | Howells . | |
| 5,152,339 | 10/1992 | Calleson | 165/173 |
| 5,236,044 | 8/1993 | Nagasaka et al. | 165/176 |
| 5,307,870 | 5/1994 | Kamiya et al. | 165/173 |
| 5,450,896 | 9/1995 | Bertva et al. | 165/173 |

FOREIGN PATENT DOCUMENTS

| | | |
|---|---|---|
| 641 985 A1 | 3/1995 | European Pat. Off. . |
| 2 614 408 | 10/1988 | France . |
| 3 222 278 C2 | 10/1984 | Germany . |
| 93/04334 | 3/1993 | WIPO . |
| 95/09340 | 4/1995 | WIPO . |

OTHER PUBLICATIONS

Patent Abstracts of Japan, vol. 15, No. 97, M–1090, abstract of JP, A, 2–309196 (Nippodenso Co. Ltd.), 25 Dec. 1990.

Patent Abstracts of Japan, vol. 8, No. 227, M–332, abstract of JP, A, 59–109789 (Nippon Radiator K.K.), 25 Jun. 1984.

International Search Report, 12 Sep. 1995.

*Primary Examiner*—Allen J. Flanigan
*Attorney, Agent, or Firm*—Morgan & Finnegan, LLP

[57] ABSTRACT

In a heat exchanger tank, a connecting plate along its longitudinal side edges is provided with flange sections which extend substantially perpendicularly from the connecting plate, the flange sections of the connecting plate each have at least one engagement surface, the legs of a casing at their free end edges are provided with engagement means extending in the longitudinal direction of the casing, the engagement means of the casing lockingly engage the engagement surface of the respective flange section, and sealing connections of the plate with the legs are achieved by brazing.

10 Claims, 3 Drawing Sheets

HEAT EXCHANGER TANK TO BE MOUNTED IN A HEAT EXCHANGER AND METHOD OF PRODUCING IT

FIELD OF THE INVENTION

The present invention relates to a heat exchanger tank to be mounted in a heat exchanger, comprising an elongate casing of essentially U-shaped cross section with a web and two legs, two opposite closure means sealingly connects with the inner periphery of a respective end of the casing, and an elongate connecting plate is connected to a heat exchanger assembly forming part of the heat exchanger, the plate sealingly connecting with said legs, and to a heat exchanger incorporating such a tank, and the like.

The invention also relates to a method of producing a heat exchanger tank, in which an elongate casing, having a web and two legs, and a connecting plate mating with the casing and intended to be connected to a heat exchanger assembly are produced and assembled.

BACKGROUND OF THE INVENTION

Heat exchangers are used in a number of different areas. A very common area of application is the cooling of circulating fluids in a motor vehicle by means of a heat exchanger in the form of a cooler. For example, this can be the cooling of the coolant which cools the engine block, or the cooling of oil circulating in the engine or in a hydraulic system in such vehicles or working machines.

One conventional type of cooler design which can be used both as a vehicle cooler for cooling the engine block, and as an oil cooler, comprises partly two cooler tanks, partly a heat exchanger assembly placed between them and connected to the tanks. One tank functions as a collection point for the heated-up cooler fluid or oil, while the other tank collects the cooled cooling fluid or oil and conveys it back to the engine.

The heat exchanger assembly includes a number of radially arranged, flat aluminium tubes with intermediately placed surface enlargers or branches, also made of aluminium. Each tank also includes a casing made of plastic, aluminium or similar material, which is produced by deep-drawing, extrusion or bending. The casing also has a connecting plate which forms the bottom of the tank and which has openings for receiving the tubes included in the heat exchanger assembly.

The tubes and branches are connected to each other by means of brazing, as are the tubes with the connecting plate.

When using an aluminium casing, it can be connected to the connecting plate by brazing in the same way as the tubes. Preferably the heat exchangers are brazed together by being placed in an oven.

Brazing is carried out by way of the parts being assembled and fixed to each other, whereupon they are placed in an oven with a protective gas atmosphere and fluid, or a vacuum oven. Brazing takes place by melting an external material layer on the respective parts and forming brazing material. Preferably brazing is carried out in one step, i.e. the parts of the heat exchanger are first assembled and then brazed together in an oven.

In certain applications, more particularly oil coolers in certain types of machines and vehicles, such as digging machines and lorries, great demands are made of the cooler, and the cooler tank has to withstand great pressure loadings. In certain types of vehicle the cooler tank is subject to pressures up to 40 bar, which compares with a conventional vehicle cooler in a private car which is subject to a pressure of approx. 1.5 bar.

The invention primarily relates to such heat exchangers, preferably oil coolers made of aluminium, which are subject to high pressures, more especially heat exchanger tanks included in such heat exchangers.

At present it is a complicated process to produce heat exchangers for such applications. The designs for present-day heat exchanger tanks, more particularly those for heat exchangers which are to withstand high pressures and are therefore at least partly of large dimensions, usually mean that the entire heat exchanger is not brazed in one step.

In order to produce a heat exchanger of sufficient strength, the integral parts must be brazed in several steps, or certain parts are soldered together, mainly the tank. This makes the process more costly and complicated.

Brazing requires that the parts to be brazed adjoin and are fixed. For this, external fixtures are currently used for the heat exchanger parts. External fixtures remove heat from the parts to be brazed together and are expensive to manufacture. Furthermore, it is a complicated and time-consuming process to fix the parts of the heat exchanger with a high degree of precision, which makes them expensive.

It is difficult to punch very thick plates. The parts which are punched, e.g. the connecting plates, are therefore usually produced as two plates lying on top of each other. It is therefore a special problem that the connecting plates included in the heat exchanger tank in high pressure application have to be produced as brazed-together plates one on top of the other. According to the state of the art, a reinforcing plate must first be attached to the connecting plate on the side of the connecting plate facing away from the tank. The heat exchanger assembly is then connected to the connecting plate. This procedure makes the manufacturing process more complicated and expensive.

In U.S. Pat. No. 4,938,284, a heat exchanger is described with an aluminium heat exchanger tank. The casing and connecting plate can be assembled before brazing. In this way the casing grips on the outside of the connecting plate. In the shown tank designs the casing must either be pushed along the connecting plate, or the casing must be formed in a thin material so as to clamp over the connecting plate and firmly deform. This makes such a design unsuitable for heat exchanger tanks which are subject to high pressures and which must be made of thick material. The assembly of the tank parts is also complicated.

A further problem in the production of heat exchanger tanks with thick material which are subject to high pressures, is the obtaining, by brazing the heat exchanger in one step, of brazing joints which withstand the loadings they are subject to during operation.

A general object of the present invention is to produce a heat exchanger tank with which the aforementioned problems can be at least partially mitigated with known technology.

A particular object of the present invention is to produce a heat exchanger tank, in which a casing can be brazed together with a connecting plate without external fixtures having to be used.

Another object of the present invention is to produce a heat exchanger tank which can be quickly, easily and accurately assembly for brazing an entire heat exchanger in one step.

A special object of the present invention is to produce a heat exchanger tank for high pressure oil coolers which has stronger connections between the parts of the heat exchanger than before.

A further special object of the present invention is to produce a heat exchanger tank having a connecting plate with a reinforcing plate which can be mounted more simply.

SUMMARY OF THE INVENTION

According to a first aspect of the present invention there is provided a heat exchanger tank to be mounted in a heat exchanger, comprising an elongate casing of essentially U-shaped cross section with a web and two legs. Two opposite closure means sealingly connect with the inner periphery of a respective end of the casing, and an elongate connecting plate to be connected to a heat exchanger assembly forms part of the heat exchanger, the plate sealingly connecting with the legs, wherein the connecting plate along its longitudinal side edges is provided with flange sections which extend substantially perpendicularly from the connecting plate. The flange sections of the connecting plate each have at least one engagement surface, the legs of the casing at their free end edges are provided with engagement means extending in the longitudinal direction of the casing. The engagement means of the casing lockingly engage the engagement surface of the respective flange section, and the sealing connections are achieved by brazing.

By providing the casing and connecting plate in the heat exchanger with engagement means mating with each other to form a snap fastening, a heat exchanger tank is produced which can be brazed without external fixtures and which can be easily and very precisely assembled for brazing. In addition, brazing of an entire heat exchanger in one step is made possible.

By producing a connecting plate with two flange sections facing the casing and the casing extending inside the flange sections to the reinforcing plate placed between the flange sections, a stronger design than hitherto known is achieved. This design is also much easier to assemble as the reinforcing plate is placed in position and fixed by the casing which snaps fast in the connecting plate. If the part of the casing extending inside the flanges is provided with internal surfaces which are slightly bent towards each other, a further increase in strength is achieved.

By further forming the engagement means of the casing in such a way that they simultaneously grip and receive the flange sections formed on the connecting plate, a brazing joint between them is relieved. This produces a heat exchanger tank which is stronger than previous heat exchanger tanks and is particularly suitable for oil coolers with a high operating pressure.

According to a second aspect of the present invention, there is provided a method of producing a heat exchanger tank, in which an elongate casing, having a web and two legs, and a connecting plate mating with the casing and intended to be connected to a heat exchanger assembly are produced and assembled. The casing and the connecting plate are provided on their edges with mating engagement means, the casing and connecting plate are moved together, and the leg edges and the plate edges being pressed against each other to bring about an engagement between the engagement means.

BRIEF DESCRIPTION OF THE DRAWINGS

The invention and its advantages will now be described in more detail below with reference to the attached drawings, which show some non-limiting examples of embodiments.

DESCRIPTION OF PREFERRED EMBODIMENTS

Figure 1:
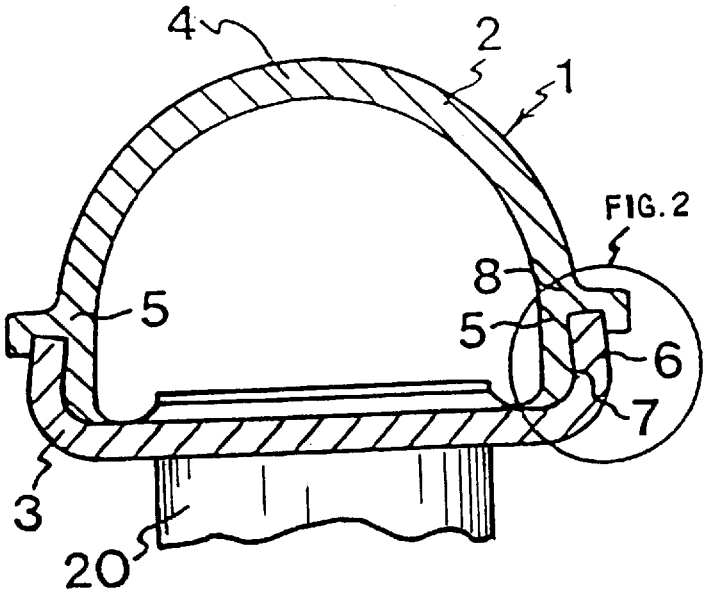
FIG. 1 is a cross-section through a heat exchanger tank in accordance with one example of embodiment of the invention.

In the figures, like reference numerals indicate like parts.

Figure 2:
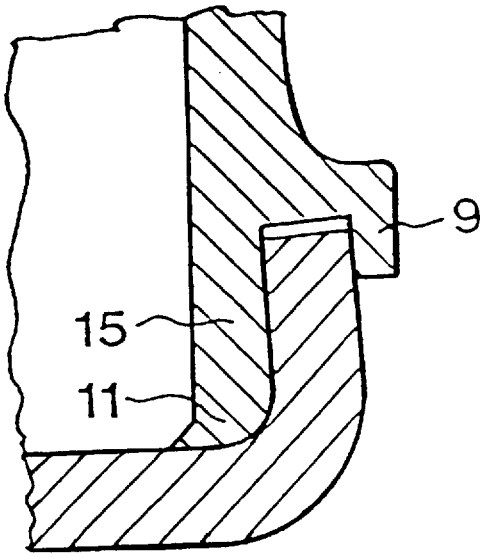
FIG. 2 is an enlargement of area II in FIG. 1.

FIGS. 1 and 2 shown a heat exchanger tank 1 for heat exchangers. The heat exchanger tank 1 comprises a casing 2 of extruded aluminium and a connecting plate 3 of extruded or bent aluminium which are brazed together.

Casing 2 is elongate, essentially U-shaped in cross-section and has two opposite end openings and a side opening extending in the longitudinal direction of the casing 2. The casing also has a web 4 and two legs 5. The legs 5 delimit the side opening. Two opposite closing means (not shown) sealingly adjoin the inner periphery at each end of the casing.

The connecting plate 3 is elongate and connected to a heat exchanger assembly 20 integrated in the heat exchanger. The tubes in the heat exchanger assembly 20 are connected to holes punched in the connecting plate 3. The plate 3 sealingly connects to the legs 5. From its longitudinal side edges, the connecting plate 3 is provided with flange sections 6 which are bent essentially at right angles from the connecting plate 3 to the casing 2 and angled towards each other.

The flange sections 6 on the connecting plate 3 each have at least one engagement means 7. In this embodiment the engagement surfaces 7 are formed on the sides turned towards each other and towards the interior of the tank.

The legs 5 of the casing are provided on their longitudinal free end edges with engagement means 8 which are arranged in the longitudinal direction of the casing 2. The engagement means 8 of the casing 2 lockingly engage the respective engagement surface 7 of the flange sections 6.

The flange sections 6 are slightly bent towards each other, which means that the surfaces of the flange 6 sides turned towards each other are slightly oblique. The engagement means 8 on the legs 5 comprises in this embodiment an inner section 15 of the legs which engages the oblique engagement surface 7 which is defined by the insides of the flange sections 6. The inner section 15 is slightly wedge-shaped or conical and is of thicker material at the outer end. In this way a surface mating with the engagement surface 7 is formed which engages through its shape with the engagement surface 7. This engagement firmly clamps the legs 5 and prevents the casing 2 and the connecting plate 3 coming apart.

The engagement means 8 of the casing 2 also comprises an outer section 9 of the legs 5 which is shorter than the inner leg section and which is in contact engagement with another, opposite side of the flange section 6, here the outside. As the leg section 9 extends along the outside of the flange section 6 and is in contact with the flange sections, the casing 2 cannot be loosened by an inward turning deformation of the legs 5. Furthermore, part of the flange section 6 is taken up in the legs 5 as the engagement means 8 of the casing 2 comprises a channel-shaped section of the legs 5. This results in a large brazing surface being provided which produces a strong brazing join.

The outer ends 11 of the casing legs 5 extend inwardly on the inside of the tank inside respective flange sections 6, the inner surfaces of the leg ends 11 being bent towards each other and the end surfaces resting on the plate. The end surfaces of the leg ends rest on the connecting plate. In this way an even surface inside the tank is produced. As sharp internal corners are avoided and the areas with small bending radii are formed with double material, the strength of the heat exchanger tank 1 is increased at its most sensitive points.

The casing 2 has a certain elastic deformability. It can therefore be deformed slightly during assembly before brazing in order to allow the engagement means 8 to act as a snap fastening along with the engagement surfaces 7 of the connecting plate 3. This temporarily changes the intervals between the end sections of the legs 5. This means that casing 2 can be simply and quickly mounted on the connecting plate 3.

During assembly the casing 2 and the connecting plate 3 are brought together with the side opening of the casing 2 turned towards the connecting plate 3 and the flange sections 6 of the connecting plate turned towards the casing 2. The legs 5 of the casing 2 are brought into contact with the plate 3 and the edges of the legs 6 are pressed together, i.e. pressed to each other in said direction to achieve engagement between the engagement means 8 of the casing 2 and the engagement surfaces 7 of the flange sections 6, the casing 2 snapping into locking engagement with the connecting plate 3. After this assembly procedure the parts are connected to each other.

The casing 2 and the connecting plate 3 are brazed after being assembled. In a preferred production method, the two closing assemblies are connected to the short sides of the casing 2 and connecting plate 3 and the heat exchanger assembly 20 to the connecting plate 3 before brazing. During brazing, which is preferably carried out in an oven in the manner described in the introduction, sealing connections are produced between the components of the heat exchanger tank 1.

Figure 3:
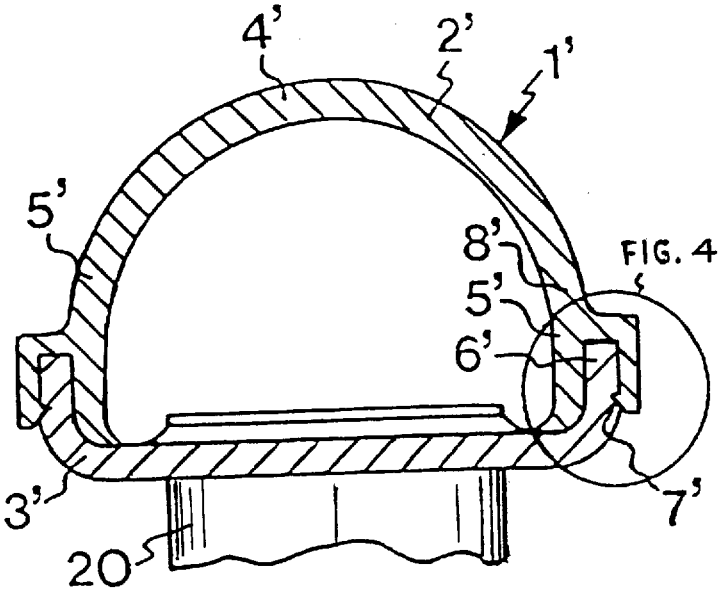
FIG. 3 is a cross-section through a heat exchanger tank in accordance with another embodiment of the invention.
Figure 4:
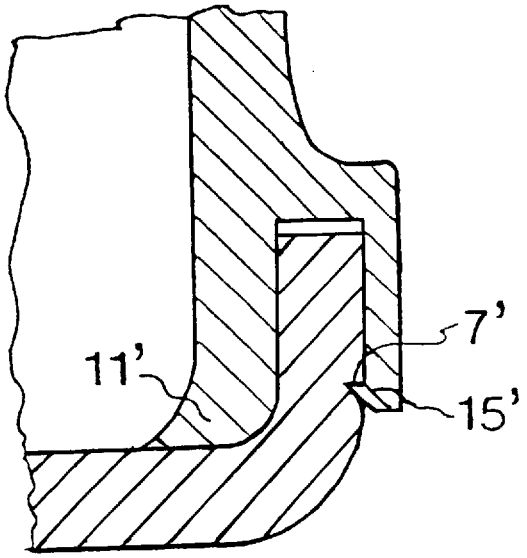
FIG. 4 is an enlargement of area IV in FIG. 3.

FIGS. 3 and 4 show another embodiment of a heat exchanger tank 1' according to the invention made entirely of aluminium. This embodiment differs from the first embodiment in that the engagement surfaces 7' of the flange sections 6' are formed on the sides turned away from each other. The engagement surfaces 7' comprise a groove formed in its sides. The groove 7' extends in the longitudinal direction of the casing 1'. In this embodiment the engagement means 8' of the casing 2' includes a hook-shaped section 15' which hooks into groove 7' of the flange sections 6'.

A certain elastic deformability of the leg sections 15' which extend from the flange sections 6' facilitate assembly in the case of this embodiment. Assembly takes place in the same way as the embodiment shown in FIG. 1, but with the difference that the casing and the connecting plate are brought towards each other until the hook section 15' snaps into the groove 7', whereby the end surfaces of the inner section 11' are in contact with the plate.

Figure 5:
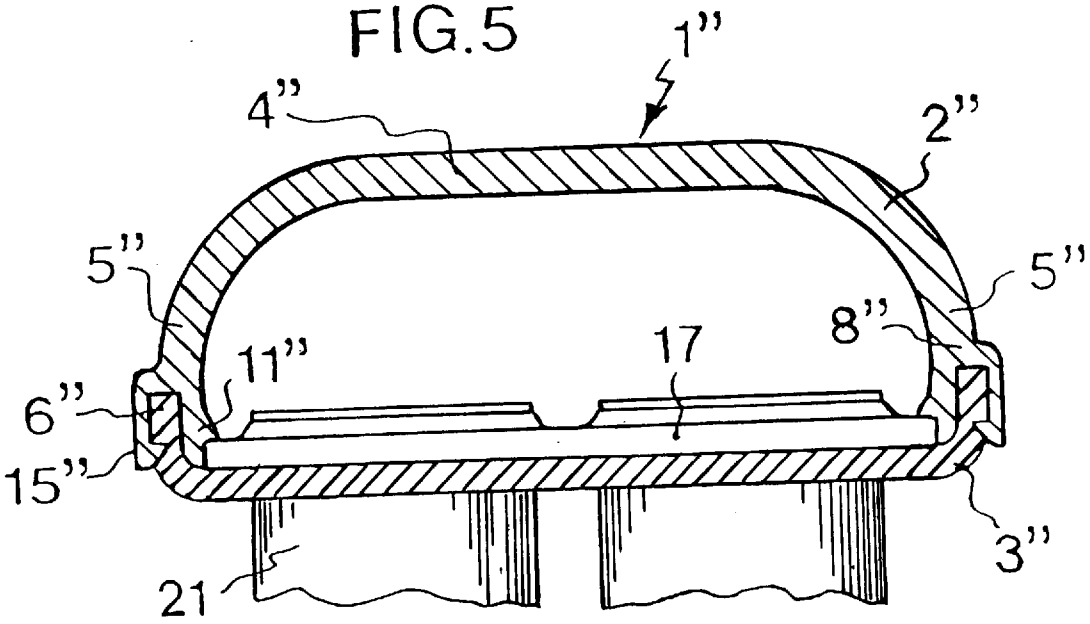
FIG. 5 is a cross-section through a heat exchanger tank in accordance with a third embodiment of the invention.

FIG. 5 shows a third embodiment of a heat exchanger 1" according to the invention made entirely of aluminium. This embodiment is similar to the embodiment in FIGS. 3 and 4 except that a reinforcing plate 17 is placed on the connecting plate 3" between the flange sections 6". The reinforcing plate 17 engages the casing 2" and is clamped by the legs 5" to the connecting plate 5". The inner end sections 11" of the legs 5" are slightly bent towards each other and their end surfaces have a right-angled recess which grips around the inward-turned side corners of the reinforcing plate 17.

Assembly of a heat exchanger tank according to this embodiment takes place in that the reinforcing plate 17 is placed on the connecting plate 3" inside the flange sections 6". The casing 2" is then snapped firmly on the connecting plate 3" and reinforcing plate 17 in the same way as in the embodiments described above. The end sections 11" of the casing legs 5" with the right-angled recess thus engage the reinforcing plate 17 and firmly clamp it to the connecting plate 3" at the same time as the engagement means 8" grips the flange sections 6".

With this embodiment of the invention, the problem is solved by firmly locking a reinforcing plate 17 to the connecting plate 3" for joint brazing to the other parts. It is also a stability advantage that the reinforcing plate 17 can be placed on the (upper side in FIG. 3) connecting plate 3" inside the flange sections 6" and clamped in four holes, instead of being firmly brazed to the other side of the connecting plate 3" (underside in FIG. 3) as has occurred hitherto.

In conclusion, it should be pointed out that the embodiments of the invention described above can advantageously be combined.

I claim:

1. A heat exchanger tank to be mounted in a heat exchanger, comprising an elongate casing of essentially U-shaped cross section with a web and two legs, an elongate connecting plate to be connected to the heat exchanger assembly forming part of the heat exchanger, the plate sealingly connecting with the legs, wherein the connecting plate along its longitudinal side, edges is provided with flange sections which extend substantially perpendicularly from the connecting plate, the flange sections of the connecting plate each have at least one engagement surface, the legs of the casing at their free and edges are provided with engagement means extending in the longitudinal direction of the casing, the engagement means of the casing lockingly engage and are brazed to the engagement surface of the respective flange section to form sealing connections therewith, wherein the engagement surface of the respective flange section is located on one side of the flange portion, and the engagement means of the causing also engage a second, opposite side of the flange section by a flush contact engagement throughout the longitudinal dimensions of said engagement surface and said engagement means.

2. The heat exchanger tank of claim 1, wherein the engagement means of the casing consist of a channel-shaped part of the legs.

3. The heat exchanger tank of claim 1, wherein a reinforcing plate is placed on the connecting plate between the flange sections and engages in the casing.

4. The heat exchanger tank of claim 3, wherein the reinforcing plate is clamped against the connecting plate by the casing legs.

5. The heat exchanger tank of claim 1, wherein the engagement means of the casing together with the engagement surface of the connecting plate, form a flush snap attachment throughout the engaged lengths thereof.

6. The heat exchanger tank of claim 1, wherein the casing has sufficient elastic deformability in order, before said brazing, to enable the engagement means, together with the engagement surfaces of the connecting plate along the entire lengths thereof to act as a flush snap attachment with a temporary change of the spacing between the end sections of the legs.

7. The heat exchanger tank of claim 1, wherein the engagement surfaces of the flange sections are formed on the side facing away from each other and that a groove is formed in said sides, said groove extending in the longitudinal direction of the tank.

8. A heat exchanger tank to be mounted in a heat exchanger, comprising an elongate casing of essentially U-shaped cross section with a web and two legs, an elongate connecting plate to be connected to the heat exchanger assembly forming part of the heat exchanger, the plate sealingly connecting with the legs, wherein the connecting plate alone its longitudinal side edges is provided with flange sections which extend substantially perpendicularly from the connecting plate, the flange sections of the connecting plate each have at least one engagement surface, the legs of the casing at their free end edges are provided with engagement means extending in the longitudinal direction of the casing, the engagement means of the casing lockingly engage the engagement surface of the respective flange section, and the sealing connections are achieved by brazing, wherein the extreme ends of the casing legs extend on the inside of the tank inwardly of the respective flange sections, the interior surfaces of the leg ends being curved towards each other.

9. A heat exchanger tank to be mounted in a heat exchanger, comprising an elongate casing of essentially U-shaped cross section with a web and two legs, an elongate connecting plate to be connected to the heat exchanger assembly forming part of the heat exchanger, the plate sealingly connecting with the legs, wherein the connecting plate along its longitudinal side edges is provided with flange sections which extend substantially perpendicularly from the connecting plate, the flange sections of the connecting plate each have at least one engagement surface, the legs of the casing at their free end edges are provided with engagement means extending in the longitudinal direction of the casing, the engagement means of the casing lockingly engage the engagement surface of the respective flange section, and the sealing connections are achieved by brazing, wherein the engagement surfaces of the flange sections are formed on the sides facing each other, and that the flange sections are slightly inclined towards each other.

10. A method of producing a heat exchanger tank, in which an elongate casing has a web and two legs, the legs having each a pair of first laterally spaced engagement means for heat exchanger tank assembly, and a connecting plate having longitudinal edges with second engagement means on the edges thereof for mating with the first laterally spaced engagement means on the casing, comprising the steps of moving the casing and connecting plate together, and pressing the second engagement means on the longitudinal plate edges into a flush relationship with the corresponding first laterally spaced engagement means to bring about a flush engagement between the engagement means along the entire lengths thereof.

* * * * *

UNITED STATES PATENT AND TRADEMARK OFFICE

CERTIFICATE OF CORRECTION

PATENT NO. : 5,816,321

DATED : October 6, 1998

INVENTOR(S) : Björn Wijkstrom

It is certified that error appears in the above-identified patent and that said Letters Patent is hereby corrected as shown below:

In Claim 1, line 30, after "side" delete ",".

In Claim 1, line 34, cancel "and" substitute --end--.

In Claim 1, line 41, cancel "causing" substitute --casing--

In Claim 5, line 56, cancel "surface" substitute --surfaces--.

In Claim 8, line 9, cancel "alone" substitute --along--.

Signed and Sealed this

First Day of June, 1999

*Attest:*

Q. TODD DICKINSON

*Attesting Officer*

*Acting Commissioner of Patents and Trademarks*